United States Patent [19]

Donahue et al.

[11] Patent Number: 4,969,428

[45] Date of Patent: Nov. 13, 1990

[54] HYPEREUTECTIC ALUMINUM SILICON ALLOY

[75] Inventors: Raymond J. Donahue, Fond du Lac; William G. Hesterberg, Rosendale; Terrance M. Cleary, Allentown, all of Wis.

[73] Assignee: Brunswick Corporation, Skokie, Ill.

[21] Appl. No.: 339,052

[22] Filed: Apr. 14, 1989

[51] Int. Cl.[5] ..... C22C 21/00

[52] U.S. Cl. ..... 123/195 R; 420/534

[58] Field of Search ..... 123/195 R; 420/534, 420/546, 547, 449, 550; 164/47, 137; 75/142, 140, 141, 147, 148

[56] References Cited

U.S. PATENT DOCUMENTS

| | | | |
|---|---|---|---|
| 1,947,121 | 2/1934 | Bonsack . | |
| 2,357,452 | 9/1944 | Bonsack . | |
| 3,092,744 | 6/1963 | Stonebrook . | |
| 3,726,672 | 4/1973 | Lindberg et al. . | |
| 3,881,879 | 5/1975 | Singleton, Jr. et al. | 29/193 |
| 4,147,074 | 4/1979 | Noguchi et al. | 420/534 |
| 4,297,976 | 11/1981 | Bruni et al. | 123/193 CP |
| 4,603,665 | 8/1986 | Hesterberg et al. | 123/195 R |

FOREIGN PATENT DOCUMENTS

| | | | |
|---|---|---|---|
| 0031530 | 10/1970 | Japan | 420/534 |
| 54-39311 | 3/1979 | Japan . | |
| 0208443 | 10/1985 | Japan | 420/534 |
| 0208444 | 10/1985 | Japan | 420/534 |
| 0228646 | 11/1985 | Japan | 420/534 |
| 1437144 | 5/1976 | United Kingdom . | |
| 2167442 | 5/1986 | United Kingdom | 420/534 |

OTHER PUBLICATIONS

Alloy Digest, Reynolds 390 and A390, Aug. 1971.
Alloy Digest, Aluminum 392.0, Sep., 1970.
Ward's Engine Update, "Top Engine Designers Laud Sleeveless Alloy Use", May 1982.

*Primary Examiner*—Andrew M. Dolinar
*Assistant Examiner*—M. Macy
*Attorney, Agent, or Firm*—Andrus, Sceales, Starke and Sawall

[57] ABSTRACT

A hypereutectic aluminum silicon alloy having an improved distribution of primary silicon in the microstructure. The alloy is composed by weight of 20% to 30% silicon, 0.4% to 1.6% magnesium, up to 1.4% iron, up to 0.3% manganese, 0.25% copper maximum and the balance aluminum. With this composition the aluminum silicon alloy system exhibits near zero shrinkage on solidification, a similarity of the liquid aluminum-silicon alloy and the primary silicon during the early stages of primary silicon precipitation, and thereby minimizes floatation of the precipitated primary silicon and to provide a more uniform distribution of the primary silicon in the microstructure and increase the wear resistant characteristics of the alloy.

7 Claims, No Drawings

HYPEREUTECTIC ALUMINUM SILICON ALLOY

BACKGROUND OF THE INVENTION

In the past aluminum alloys, due to their light weight, have been used for engine blocks for internal combustion engines. To provide the necessary wear resistance for the cylinder bores, it has been customary to chromium plate the cylinder bores, or alternately, to use cast iron liners in the bores. It is difficult to uniformly plate the bores, and as a result, plating is an expensive operation. The use of cast iron liners increases the overall cost of the engine block as well as the weight of the engine.

Hypereutectic aluminum silicon alloys containing from about 16% to 19% by weight of silicon possess good wear resistant properties achieved by the precipitated primary silicon crystals. The conventional aluminum silicon alloy usually contains a substantial amount of copper, generally in the range of 4.0% to 5.0%. Because of the high proportion of copper, the alloy has a relatively wide solidification temperature range in the neighborhood of about 250° F. to 300° F. which severely detracts from the castability of the alloy. The copper also reduces the corrosion resistance of the alloy in salt water environments and thus prevents its use for marine engines.

U.S. Pat. No. 4,603,665 describes an improved hypereutectic aluminum silicon casting alloy having particular use in casting engine blocks, or other components, for marine engines. The alloy of that patent contains by weight from 16% to 19% silicon, up to 1.4% iron, 0.4% to 0.7% magnesium, up to 0.3% manganese, less than 0.37% copper and the balance aluminum. As the copper content is minimized, the aluminum-silicon-copper eutectic is correspondingly eliminated, with the result that the alloy has a relatively narrow solidification range less than 150° F.

Normally the solid phase in a "liquid plus solid" field has either a lower or higher density, but almost never the same density, as the liquid. If the solid phase is less dense than the liquid phase, floatation of the solid phase will result. On the other hand, if the solid phase is more dense, settling of the solid phase will occur. In either case, an increased or widened solidification range will increase the time period for solidification and accentuate the phase separation. With an aluminum silicon alloy the floatation condition prevails and the alloy solidifies with a large mushy zone because of its high thermal conductivity and the absence of the skin formation typical of steel castings. This leads to liquid feeding problems at the micron level during solidification and can also result in significant amounts of microporosity.

When casting large components, such as engine blocks, floatation of primary silicon into the risers of sand castings results in a non-uniform distribution of primary silicon and therefore detracts from the wear resistance of the alloy. For yet unknown reasons, there is a non-uniform distribution of primary silicon in die cast engine blocks.

It is recognized that increasing the silicon content beyond the 16% to 19% range correspondingly widens the solidification range, and as a widening of the solidification range would normally be expected to increase the floatation and contribute to non-uniformity of primary silicon, alloys of higher silicon content have not been candidates for casting engine blocks or engine components.

SUMMARY OF THE INVENTION

The invention is directed to a hypereutectic aluminum silicon alloy containing in excess of 20% by weight of silicon and having an improved distribution of primary silicon in the microstructure.

In general the alloy contains by weight from 20% to 30% of silicon, and preferably from 25% to 28%, 0.5% to 1.3% magnesium, up to 1.4% iron, up to 0.3% manganese, 0.25% copper maximum and the balance aluminum.

Most metals, including aluminum, exhibit a volume increase during the solid-liquid phase transition, i.e. melting, and correspondingly exhibit a volume decrease on solidification. Silicon, on the other hand, acts oppositely and exhibits the largest known volume decrease on melting.

It has been discovered that with the alloy of the invention utilizing 20% to 30% by weight of silicon, the shrinkage of the aluminum on solidification tends to be balanced by the expansion of the silicon on solidification, so that the aluminum-silicon alloy system exhibits near zero shrinkage. This near zero shrinkage, and the similarity of the densities of the liquid aluminum-silicon alloy and the primary silicon during the early stages of primary silicon precipitation are believed to minimize floatation and result in a more uniform distribution of the primary silicon in the microstructure of the cast alloy.

Due to the high silicon content along with the uniform distribution of the primary silicon in the microstructure, improved wear resistance is achieved, making the alloy particularly suitable for use as engine components, such as engine blocks.

As the copper content is maintained at a minimum, the alloy has improved resistance to salt water corrosion, so that it is particularly useful for casting blocks and other components for marine engines. With the elimination of the functional need for copper, the alloy's age hardening response is obtained with magnesium, an element that does not adversely affect the corrosion-resistance.

DESCRIPTION OF THE ILLUSTRATED EMBODIMENT

The hypereutectic aluminum silicon casting alloy of the invention has the follow general composition in weight percent:

| | |
|---|---|
| Silicon | 20% to 30% |
| Magnesium | 0.4% to 1.6% |
| Iron | Up to 1.4% |
| Maganese | Up to 0.3% |
| Copper | Up to 0.25% |
| Aluminum | Balance. |

The alloy has the following preferred composition in weight percent:

| | |
|---|---|
| Silicon | 25% to 28% |
| Magnesium | 0.8% to 1.3% |
| Iron (For die casting and permanent mold applications) | Up to 1.0% |
| Iron (For premium strength alloys) | Up to 0.2% |
| Manganese | Up to 0.3% |
| Copper | Up to 0.2% |

-continued

| | |
|---|---|
| Aluminum | Balance. |

Iron is virtually insoluble in the alloy and occurs as an intermediate compound. If the iron is less than 0.6%, the compound occurs as small needles and plates in the eutectic; at higher values it occurs in a massive form and causes brittleness. Die casting and permanent mold casting use the higher concentration of iron to prevent soldering of the aluminum alloy to the steel dies. Manganese presented as an impurity, or as an alloying element, combines with the silicon and iron to form a constituent, which is tough rather than brittle and therefore tends to reduce the deleterious effect of high iron.

It has been recognized that by increasing the silicon content in a hypereutectic aluminum silicon alloy, the solidification temperature range is correspondingly increased or widened. It has been further recognized that an increased solidification range contributes to phase separation either by floatation, if the solid phase is less dense then the liquid phase as in an aluminum silicon alloy, or by settling if the solid phase is more dense than the liquid phase. Phase separation caused by floatation will result in a less uniform distribution of the primary silicon in the solidified alloy which will detract from the desired wear resistance of the alloy even though the increased silicon content would normally be expected to increase the hardness.

The invention is based on the discovery that there is a specific relationship between the silicon and aluminum contents which results in a similarity in densities of the liquid aluminum-silicon alloy and the primary silicon, and a near zero shrinkage on solidification, thus minimizing floatation of the primary silicon and resulting in a more uniform distribution of primary silicon in the microstructure.

Most pure metals exhibit a volume increase of about 4% during melting or during the solid-liquid phase transition, and conversely exhibit a volume decrease on solidification. The volume change on melting for aluminum is somewhat higher, showing an increase in volume of about 6.9%. Silicon, on the other hand, acts oppositely during the solid-liquid phase transition and exhibits the largest known volume decrease on melting, a decrease of about 9.5%. It is believed that for silicon, the rigid and directional bonds of the solid are apparently broken on melting and the atoms thus behave in a more spherical manner and pack closely together.

As aluminum and silicon exhibit opposite volume changes on melting and solidification, it has been found that a composition exists in the aluminum silicon alloy system that will exhibit near zero shrinkage on solidification. It has been discovered that above the eutectic composition, the shrinkage of aluminum-silicon alloys decreases linearly with increasing silicon content, arriving at a near zero shrinkage at a 25% to 28% silicon content. As the liquids temperature increases with increasing silicon content, the density of the liquid aluminum-silicon decreases, both because of the composition change and the temperature change. While the density of the liquid is changing both due to composition and temperature, the density of the pure silicon phase does not change to the same degree because the composition is fixed at 100% silicon and because the phase is solid and more resistant to change, due to temperature, than the liquid. Since silicon phase embryos do not rise through the melt as rapidly, due to the similarity of densities of the solid and liquid phase, it is believed that primary phase growth is inhibited and contributes to more nucleation which results in a smaller sized primary that, of course, floats out of the melt more slowly. It is believed that this near zero shrinkage and the density similarity of the liquid and solid phases during the early stages of solidification are the primary reasons for the improved uniformity of distribution of primary silicon in the microstructure of the alloy.

If the silicon content is below 20% by weight a minimal affect is achieved on floatation and little improvement is shown in the distribution of primary silicon in the microstructure. If the silicon content is increased beyond approximately 30% by weight, the agglomeration of silicon becomes objectionable, the machinability becomes increasingly more difficult, and the ductility decreases. Thus, there is a practical limit for usefulness of an alloy having more than 30% silicon.

The following table illustrates the improvement in distribution of primary silicon achieved through the alloy of the invention. The uniformity of primary silicon is measured with the values obtained for the coefficient of variation of the silicon volume fraction. This is determined by measuring individual cross-sections 5.86 $mm^2$ with at least 25 fields of view being measured. The measurement is done with a microscope interfaced to a computer for quantitative analysis with the field of view magnified 50× and containing, on average, at least 50 primary silicon particles in each field of view.

Using this method, a comparison was made between a hypereutectic aluminum silicon alloy containing 17.0% silicon, 0.2% manganese, 0.1% iron, 0.6% magnesium, 0.15% copper and the balance aluminum and an alloy of the invention containing 25% by weight of silicon, 0.1% iron, 0.1% manganese, 0.8% magnesium, 0.14% copper and the balance aluminum.

The results of the comparison are shown in the following table for two properly phosphorous modified alloys cast under identical casting conditions into evaporable polymeric foam backed up with sand.

TABLE 1

| Alloy | Coefficient of Variation Silicon Volume Fraction |
|---|---|
| 1. 17% silicon | 47.1% |
| 2. 25% silicon | 34.5% |

The above comparison shows that the coefficient of variation of the silicon volume fraction was reduced from 47.1% with a 17% silicon alloy to 34.5% with the 25% silicon alloy of the invention, thus the primary silicon phase distribution is 36.5% more uniform for the 25% silicon alloy than for the 17% silicon alloy. In general, the alloy exhibits a coefficient of variation less than 40%.

In the alloy of the invention, the copper content is maintained below 0.25% and preferably at a minimum. By minimizing the copper content, the corrosion resistance of the alloy to salt water environments is greatly improved, making the alloy particularly useful for engine blocks for marine engines and other components requiring strength, wear resistance, and corrosion resistance.

The magnesium allows the alloy to obtain age hardening properties. In general, the heat treatment consists of heating the alloy to a solution temperature in the range of about 950° to 1010° F., and preferably 1000° F., quenching the alloy in boiling water, and then aging at a temperature in the range of 300° F. to 350° F. and preferably about 310° F. for a period of 3 to 6 hours. With this heat treatment the ultimate tensile strength can be raised from about 13,600 psi, in the as cast condition, to about 23,000 psi in the heat treated condition. Designing a higher tensile strength in an alloy with limited ductility, such as a high silicon hypereutectic aluminum-silicon alloy, requires the elastic strain capability to be built into the copper-free matrix of the alloy since stress is proportional to strain. Copper dissolved in the matrix of hypereutectic alloys decreases the elastic strain capability. The alloy in both the as cast and heat treated condition has an elongation in two inches of 0.2%.

In addition to the improved uniformity of the primary silicon distribution, the alloy is capable of withstanding a larger fracture strain in the matrix due to the minimum copper content. The modulus of silicon is greater than that of aluminum and thus in the aluminum-silicon composite, the silicon will carry a greater fraction of the load since the aluminum-silicon matrix and the silicon particles are under equal strain during tensile or compression loading. The load carrying limitation of the alloy composite is the fracture strain limit that the matrix can sustain.

Due to the high silicon content, the solidification range of the alloy of the invention is in the range of about 250° F. to 300° F., which is greater than that of the alloy described in U.S. Pat. No. 4,603,665. But because of the near zero shrinkage rate of the alloy system and the similarity of the densities of the liquid aluminum-silicon and the primary silicon during the early stages of primary silicon precipitation, the increased solidification range does not correspondingly increase the non-uniformity of distribution of primary silicon, as would be expected.

Due to the uniform distribution of silicon particles in the microstructure, the minimum copper content and specific magnesium composition range, the alloy of the invention has particular use in casting engine blocks for marine engines. Because of the excellent wear resistance, the necessity of plating the cylinder bores or using cast iron liners is eliminated.

Various modes of carrying out the invention are contemplated as being within the scope of the following claims particularly pointing out and distinctly claiming the subject matter which is regarded as the invention.

We claim:

1. A hypereutectic aluminum silicon casting alloy consisting essentially by weight of 20% to 30% of silicon, 0.4% to 1.6% of magnesium, less than 0.25% copper and the balance aluminum, said alloy having a substantially uniform distribution of primary silicon in the microstructure of the cast alloy and said alloy having a coefficient of variation of primary silicon volume fraction of less than 40%.

2. The alloy of claim 1, wherein the silicon is present in the amount of 25% to 28% by weight.

3. The alloy of claim 1, and also containing by weight up to 1.4% iron and up to 0.3% manganese.

4. The alloy of claim 2 and characterized by having a substantially zero shrinkage rate on solidification.

5. A cast component for a marine engine, comprising a casting consisting essentially by weight of 20% to 30% of silicon, 0.4% to 1.6% of magnesium, less than 0.25% copper and the balance aluminum, said alloy having a substantially uniform distribution of primary silicon particles in the microstructure of the cast component.

6. The component of claim 5, wherein said component comprises an engine block having a plurality of cylinder bores, said engine block having said primary silicon particles substantially uniformly distributed throughout said block and including the area bordering said bores.

7. A hypereutectic aluminum silicon casting alloy consisting essentially by weight of 25% to 28% silicon, 0.8 to 1.3% magnesium, less than 0.2% iron, less than 0.3% manganese, less than 0.2% copper and the balance aluminum, said alloy containing precipitated primary silicon crystals, the density of said silicon crystals being substantially similar to the density of the liquid-aluminum-silicon alloy during early stages of precipitation of said crystals to minimize flotation of the silicon particles and provide a more uniform distribution of primary silicon in the cast alloy.

* * * * *